US006398010B1

(12) United States Patent
Fangmeier

(10) Patent No.: US 6,398,010 B1
(45) Date of Patent: Jun. 4, 2002

(54) DEVICE FOR DEPOSITING FLAT OBJECTS, CONVEYED INDIVIDUALLY IN SUCCESSION, ON A FORWARDING CONVEYOR IN SHINGLE FORMATION

(75) Inventor: Ralf Fangmeier, Lengerich (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/413,195

(22) Filed: Oct. 5, 1999

(30) Foreign Application Priority Data

Oct. 6, 1998 (DE) ..... 198 46 032

(51) Int. Cl.[7] ..... B65G 47/31; B65G 43/00; B65G 47/26; B65H 5/34; B65H 5/02

(52) U.S. Cl. ..... 198/462.2; 198/460.3; 198/462.1; 271/270; 271/273

(58) Field of Search ..... 198/460.3, 461.1, 198/461.3, 462.1, 462.2; 271/151, 202, 270, 273

(56) References Cited

U.S. PATENT DOCUMENTS 4,364,552 A * 12/1982 Beseman ..... 271/202 X
4,577,746 A * 3/1986 Tokumo et al. ..... 271/202 X
4,667,953 A * 5/1987 Hirakawa et al. ..... 271/202 X
4,732,262 A * 3/1988 Labombarde ..... 198/462 X
4,973,039 A * 11/1990 Jeske et al. ..... 271/202 X
5,054,763 A * 10/1991 Achelpohl et al. ..... 271/202 X
5,496,024 A * 3/1996 Luehti et al. ..... 271/273 X
5,909,873 A * 6/1999 Littleton ..... 271/270 X

FOREIGN PATENT DOCUMENTS

DE 2 141 340 2/1973

* cited by examiner

*Primary Examiner*—Christopher P. Ellis
*Assistant Examiner*—Gene O. Crawford
(74) *Attorney, Agent, or Firm*—Jacobson Holman, PLLC

(57) ABSTRACT

Flat objects, conveyed in succession, are deposited on a slower forwarding conveyor in shingle formation so that a decelerating unit settles from the top on the deposited objects. To guarantee a flawless deposit of the workpieces in shingle formation, the decelerating unit comprises a group of bands or belts, which rotate parallel to each other over deflecting rolls and which are driven at the same speed as the forwarding conveyor and which are forced against the self-forming workpiece shingle, by means of the wheels or rolls, mounted on swivelable levers.

14 Claims, 2 Drawing Sheets

DEVICE FOR DEPOSITING FLAT OBJECTS, CONVEYED INDIVIDUALLY IN SUCCESSION, ON A FORWARDING CONVEYOR IN SHINGLE FORMATION

BACKGROUND OF THE INVENTION

1. Field of the Invention

The invention relates to a device for depositing flat objects, preferably paper tube segments, sack workpieces or sacks, which are conveyed individually in succession, on a slower forwarding conveyor in shingle formation using a decelerating unit that settles from the top on the deposited objects.

2. Description of the Related Art

Devices of this type exist in various embodiments. They have the problem of decelerating objects, fed in at a relatively high speed, in such a manner that they are deposited undamaged without being twisted, crushed or bent on the slower forwarding conveyor with the same overlapping lengths and in a straight orientation to each other.

A known device of the type described in the introductory part is depicted as a schematic in FIG. 1. In this known device tube segments 2, which are spaced apart, are conveyed by a belt conveyor 1 at a relatively high speed v1 and thrown on a subsequent, upwardly sloping belt conveyor, which rotates at a lower speed v2, whereby the fed-in tube segments are decelerated in such a manner that they assume a shingle formation and are forwarded continuously in said formation. To facilitate the depositing in the illustrated shingle formation, several swivelable rods 4 and rolls 6, which are pivot-mounted on pivot-mounted levers 5, are provided that engage with the rods 4 and roll down on the shingle formation that is being configured with the workpieces. In so doing, the swivelable rods 4 serve primarily to guide the fed-in workpieces 2 and also to decelerate them. However, the main braking function is assumed by the rolls or wheels 6, which are designed as brake rolls. The rods 4 and the swivelable levers 6 are mounted on sleeves or slidable carriages 7, 8 by means of joints 9, 10, which can be slid on guide rods 11 in the machine frame and can be guided into set positions so as to be fixed in position. An adjustment of the sleeves 7, 8 on the guide rods 11 results in the rods 4 and brake wheels 6 being adjusted relative to the length of the respective workpiece to be deposited. The brake wheels 6, which engage with the rods 4, can be provided in smaller number than the brake rods. In the known device not only the displacement and adjustment of the rods 4 and the brake wheels 6 relative to the format of the workpieces to be deposited is difficult, but this device can also fail when, after the workpieces 2 collide with the rods 4, they lie crooked or the crumpled leading edge stands upright so that the workpieces, which are, therefore, held back by the rods 4, lie diagonally, resulting in disturbances and also a pile-up.

SUMMARY OF THE INVENTION

Therefore, the object of the invention is to provide a device of the type described in the introductory part that can be easily adjusted to the modified format of the workpieces and that avoids with high certainty disturbances during the deposit phase of the workpieces.

The invention solves this problem in that the decelerating unit comprises a group of bands or belts, which rotate parallel to each other over deflecting rolls and which are driven at the same speed as the forwarding conveyor and which are forced against the shingle formation, formed by the workpieces, by the wheels or rolls, mounted on swivelable levers.

The device, according to the invention, prevents the objects to be deposited from being tilted, crushed, or distorted by providing driven, decelerating belts, which in the improbable case of a pile up forward the workpieces, which were incorrectly deposited or damaged by bending, with the shingle and pull them out of the error region, since the belts, which settle on the shingle, interact with the forwarding conveyor belt just like a twin belt conveyor.

Expediently the belts are made of an elastic material. If the belts are made of rubber or another elastomeric material, the objects to be offset-stacked are decelerated even more gently and deposited.

Expediently the swivelable levers can be adjusted in the direction of travel and in the opposite direction of travel so that the rolls or wheels that force the belts down can be readily and easily adjusted to a changed format.

The forwarding conveyor consists expediently of an upwardly sloping conveyor belt.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 2:
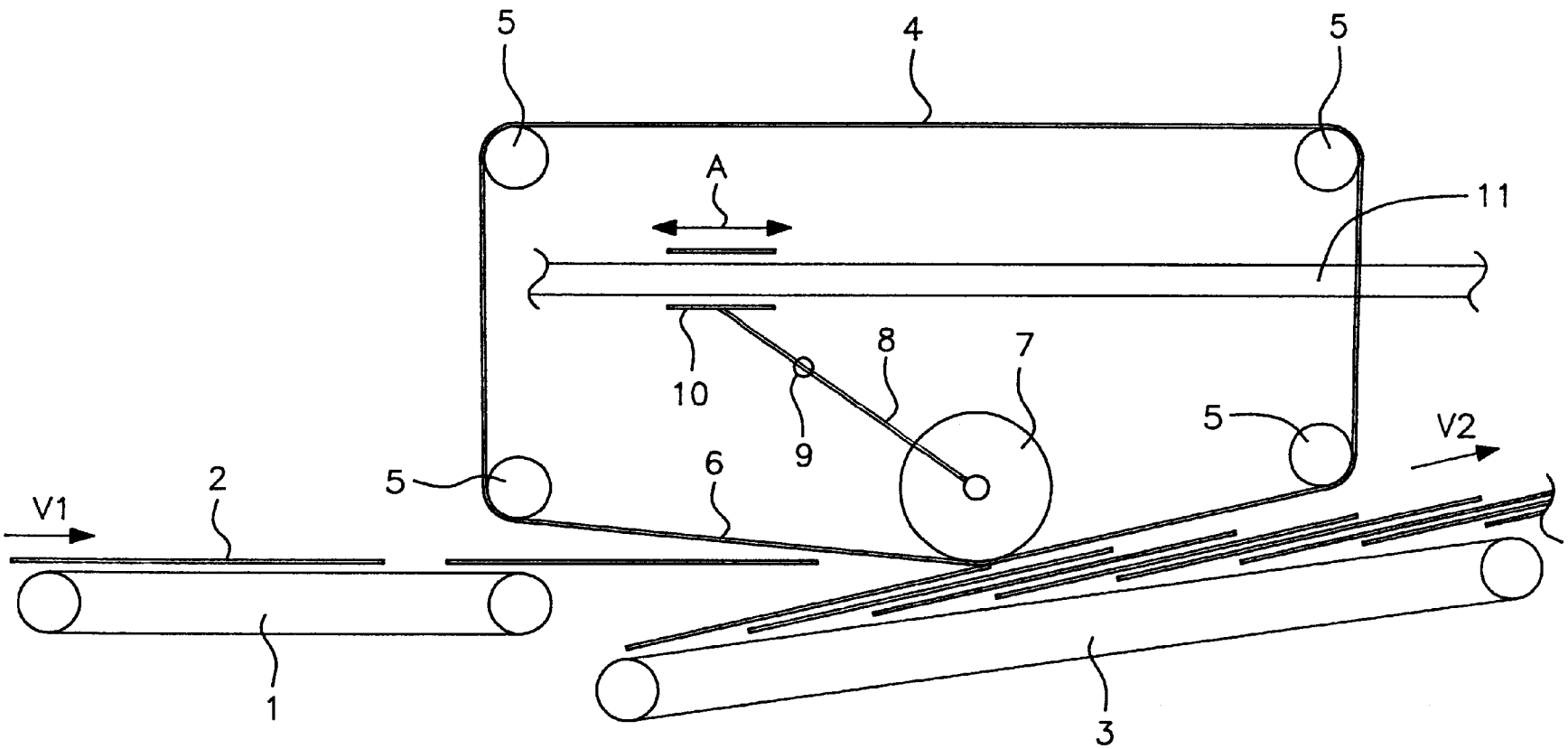
FIG. 2 shows a device for depositing flat objects, in accordance with the present invention.

One embodiment of the invention is explained in detail below with reference to FIG. 2, which is a diagrammatic side view of the device, according to the invention.

Figure 1:
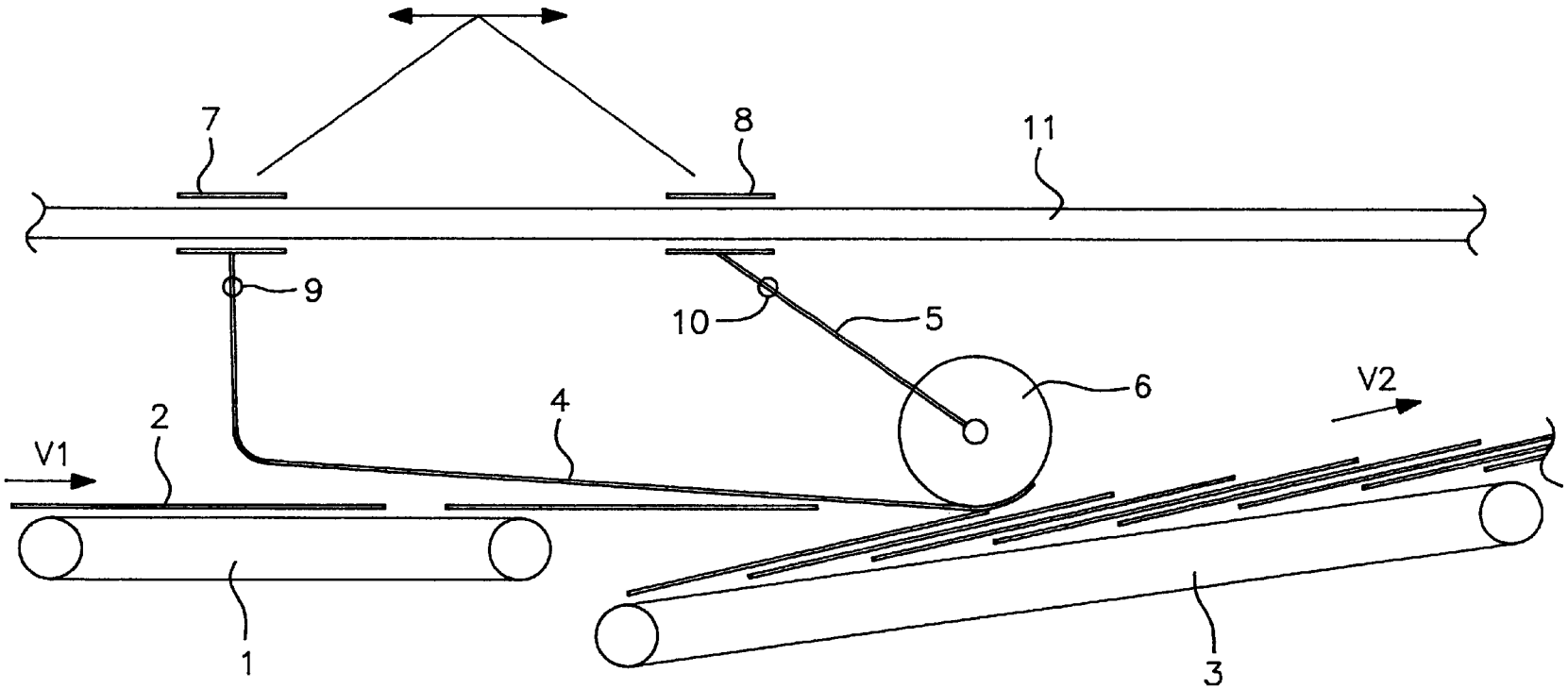
FIG. 1 (PRIOR ART)
FIG. 1 shows a device for depositing flat objects, according to the prior art.

The flat workpieces 2, which are fed in by the belt conveyor 1 at higher speed v1, are thrown, as described with reference to FIG. 1, on the upwardly sloping belt conveyor 3 in the illustrated shingle formation and forwarded by said conveyor at the lower speed v2.

Above the forwarding belt conveyor 3 are a group of parallel continuous belts 4, which run for their guide over deflecting rolls 5, of which one has a drive, which drives the group of continuous belts 4 at the speed v2 of the forwarding conveyor belt 3. The bottom strands 6 of the continuous belts 4 run over wheels or rolls 7, which are mounted on the ends of levers 8 so as to rotate freely. The levers are connected by means of joints 9 to carriages or pipe segments 10, which can be slid on guide rods 11 in the direction of the double arrow A and can be fixed in various set positions. With reference to the double arrow A, pipe segments 10 are moved to the left if the workpieces 2 are shorter and, conversely, are moved to the right if the workpieces 2 are longer. The guide rods 11 are fastened in a machine frame, which is not shown for the sake of a better overview.

The rolls 7, which are pivot-mounted on the swivelable levers 8, force the bottom strands 6 of the continuous belts 4 under their own weight against the workpiece shingle, forming on the conveyor belt 3. In so doing, the pipe pieces 10, bearing the swivelable levers 8, are adjusted in such a manner in the area of the bottom strands 6 of the continuous belts that the rolls 7 rest against the self-forming workpiece shingle, in which the leading edges of the deposited workpieces assume their position in the shingle formation.

Depending on whether shorter or longer workpieces 2 are to be deposited, the pipes 10 are slid to the left or the right on the guide rods 11.

To form the workpiece shingle, there are at least two rotating belts 4 and two rolls 7, forcing the bottom strands 6 against the self-forming shingle.

The device, according to the invention, allows the workpieces 2 to be deposited gently, accurately with respect to position and undamaged in the illustrated shingle formation since said workpieces are gently decelerated in the wedge-shaped slit between the self-forming shingle and the bottom strands 6 of the rotating belts 4. The bottom strands 6 form together with the forwarding conveyor belt 3 a twin belt conveyor so that the shingle is also forwarded in the case that in the exceptional case pile-ups occur or workpieces are to be deposited diagonally.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A device for depositing individually conveyed flat objects in shingle formation, comprising:

a first belt conveyor for feeding individual flat objects at a first speed;

a forwarding belt conveyor for receiving flat objects deposited by said first belt conveyor, said forwarding belt conveyor moving at a second speed which is slower than said first speed such that, as deposited, said flat objects overlap in a shingle formation on said forwarding belt conveyor; and a decelerating unit located above said first belt conveyor and said forwarding belt and having a continuous belt which is driven at said second speed, said continuous belt contacting objects still on said first conveyor belt and objects that have been transferred to said forwarding belt conveyor and decelerating said flat objects forming the shingle formation.

2. The device as set forth in claim 1, wherein said forwarding belt conveyor slopes upwardly relative to said first conveyor belt.

3. The device as set forth in claim 1, wherein said continuous belt runs over and is guided by a plurality of deflecting rolls, one of said deflecting rolls actively driving said belt at said second speed.

4. The device as set forth in claim 1, wherein said decelerating unit includes a wheel mounted on a swivelable lever, said continuous belt runs over said wheel and said lever being adjusted such that said wheel rests against said shingle formation.

5. The device as set forth in claim 4, wherein said continuous belt includes a plurality of continuous belts rotating parallel with one another and running over said wheel.

6. The device as set forth in claim 4, wherein said wheel and lever are adjustable relative to a direction of travel of said objects on said forwarding belt conveyor.

7. The device as set forth in claim 4, wherein said continuous belt runs over and is guided by a plurality of deflecting rolls such that said continuous belt has an upper strand and a bottom strand, said bottom strand running over said wheel and together with the forwarding belt conveyor forming a twin belt conveyor for moving said shingle formation.

8. The device as set forth in claim 7, wherein a portion of said bottom strand located before said wheel, relative to a direction of travel of said continuous belt, contacts objects still on said first conveyor belt.

9. A device for depositing individually conveyed flat objects in shingle formation, comprising:

a first belt conveyor for feeding individual flat objects at a first speed;

a forwarding belt conveyor for receiving flat objects deposited by said first belt conveyor in a transfer zone, said forwarding belt conveyor moving at a second speed which is slower than said first speed such that, as deposited, said objects overlap in a shingle formation on said forwarding belt conveyor;

a decelerating unit having a plurality of continuous belts which are actively driven at said second speed and rotate parallel with one another over a plurality of wheels, said plurality of continuous belts being placed into contact with said flat objects in said transfer zone by adjustment of said wheels and acting to decelerate said flat objects forming the shingle formation, said plurality of continuous belts running over and being guided by a plurality of deflecting rolls such that said plurality of continuous belts have upper strands and bottom strands, said bottom strands running over said wheels which rest against said shingle formation, said plurality of continuous belts contacting objects still on said first conveyor belt and objects that have been transferred to said forwarding belt conveyor.

10. The device as set forth in claim 9, wherein said wheels are mounted on swivelable levers which are adjustable relative to either a forward or reverse direction of travel of said objects on said forwarding belt conveyor.

11. The device as set forth in claim 9, wherein said forwarding belt conveyor slopes upwardly relative to said first conveyor belt.

12. The device as set forth in claim 9, wherein one of said plurality of deflecting rolls actively drives said plurality of continuous belts at said second speed.

13. The device as set forth in claim 10, wherein said plurality of continuous belts extends completely over the transfer zone to ensure correct position of said objects on said forwarding belt conveyor.

14. The device as set forth in claim 9, wherein a portion of said bottom strands located before said wheels, relative to a direction of travel of said plurality of continuous belts, contacts objects still on said first conveyor belt.

* * * * *